US007942577B2

(12) United States Patent
Fraser et al.

(10) Patent No.: US 7,942,577 B2
(45) Date of Patent: May 17, 2011

(54) FLEXIBLE BAG HAVING A DRAWTAPE CLOSURE

(75) Inventors: Robert W. Fraser, Lombard, IL (US); Charles B. Snoreck, Chicago Ridge, IL (US)

(73) Assignee: The Procter & Gamble Company, Cincinnati, OH (US)

( * ) Notice: Subject to any disclaimer, the term of this patent is extended or adjusted under 35 U.S.C. 154(b) by 1190 days.

(21) Appl. No.: 11/637,580

(22) Filed: Dec. 12, 2006

(65) Prior Publication Data

US 2008/0137995 A1 Jun. 12, 2008

(51) Int. Cl.
*B65D 33/28* (2006.01)
*B65D 33/16* (2006.01)

(52) U.S. Cl. ..... 383/72; 383/71; 383/75

(58) Field of Classification Search ..... 383/75, 383/77, 105, 903, 71, 72
See application file for complete search history.

(56) References Cited

U.S. PATENT DOCUMENTS

| | | | |
|---|---|---|---|
| 584,555 | A | 6/1897 | Lorenz |
| 605,343 | A | 6/1898 | Ross |
| 1,853,374 | A | 4/1932 | Oxhandler |
| 2,653,751 | A | 9/1953 | Vogt |
| 3,186,626 | A | 6/1965 | Shvetz |
| 3,217,971 | A | 11/1965 | Shvetz |
| 3,224,574 | A | 12/1965 | McConnell et al. |
| 3,254,828 | A | 6/1966 | Lerner |
| 3,367,380 | A | 2/1968 | Dickey |
| 3,411,698 | A | 11/1968 | Reynolds |
| 3,462,067 | A | 8/1969 | Shore |
| 3,549,381 | A | 12/1970 | Kinsinger |
| 3,575,781 | A | 4/1971 | Pezely |
| 3,682,372 | A | 8/1972 | Rodley |
| 3,738,565 | A | 6/1973 | Ackley et al. |
| 3,904,465 | A | 9/1975 | Haase et al. |
| 3,970,241 | A | 7/1976 | Hanson |
| 3,973,063 | A | 8/1976 | Clayton |
| 4,555,605 | A | 11/1985 | Brown et al. |

(Continued)

FOREIGN PATENT DOCUMENTS

DE 703818 3/1941

(Continued)

OTHER PUBLICATIONS

International Search Report for PCT/IB2007/055005 mailed Apr. 16, 2008 (6 pages).

*Primary Examiner* — Jes F Pascua
(74) *Attorney, Agent, or Firm* — Brent M. Pebbles; David K. Mattheis; Kelly L. McDow

(57) ABSTRACT

A flexible bag comprises flexible sheet material assembled to form a semi-enclosed container having an opening. The bag has a drawtape closure for sealing the opening. The sheet material of the drawtape closure exhibits elastic-like behavior along at least one axis. The sheet material of the drawtape closure comprises a first region and a second region. The first region and said second region are comprised of the same material composition and each has an untensioned projected pathlength. The first region undergoes a substantially molecular-level deformation and the second region initially undergoes a substantially geometric deformation when the sheet material is subjected to an applied elongation in a direction substantially parallel to an axis in response to an externally-applied force upon the sheet material of the drawtape closure.

6 Claims, 4 Drawing Sheets

U.S. PATENT DOCUMENTS

| | | | | | |
|---|---|---|---|---|---|
| 4,567,984 | A | | 2/1986 | Gietman, Jr. | |
| 4,571,337 | A | | 2/1986 | Cage et al. | |
| 4,583,642 | A | | 4/1986 | Blythe et al. | |
| 4,597,494 | A | | 7/1986 | Benoit | |
| 4,612,431 | A | | 9/1986 | Brown et al. | |
| 4,661,671 | A | | 4/1987 | Maroszek | |
| 4,736,450 | A | | 4/1988 | Van Erden et al. | |
| 4,739,884 | A | | 4/1988 | Duplessy | |
| 4,742,203 | A | | 5/1988 | Brown et al. | |
| 4,762,430 | A | * | 8/1988 | Bullard | 383/75 |
| 4,781,301 | A | | 11/1988 | Le Bret et al. | |
| 4,808,421 | A | | 2/1989 | Mendenhall et al. | |
| 4,848,930 | A | | 7/1989 | Williams et al. | |
| 4,849,090 | A | | 7/1989 | Case et al. | |
| 4,850,508 | A | | 7/1989 | Lee | |
| 4,890,736 | A | | 1/1990 | Johannes | |
| 4,898,477 | A | | 2/1990 | Cox et al. | |
| 4,904,092 | A | | 2/1990 | Campbell et al. | |
| 4,930,644 | A | | 6/1990 | Robbins, III | |
| 4,938,608 | A | | 7/1990 | Espinosa | |
| 5,044,774 | A | | 9/1991 | Bullard et al. | |
| 5,061,500 | A | | 10/1991 | Mendenhall | |
| 5,140,119 | A | | 8/1992 | Brown et al. | |
| 5,167,377 | A | | 12/1992 | Chalmers | |
| 5,186,988 | A | | 2/1993 | Dixon | |
| 5,195,829 | A | | 3/1993 | Watkins et al. | |
| 5,205,650 | A | | 4/1993 | Rasmussen | |
| 5,246,110 | A | | 9/1993 | Greyvenstein | |
| 5,265,962 | A | * | 11/1993 | Ogawa et al. | 383/75 |
| 5,290,104 | A | | 3/1994 | Sengewald | |
| 5,314,252 | A | | 5/1994 | Happ | |
| 5,364,189 | A | | 11/1994 | Kuge et al. | |
| 5,507,579 | A | | 4/1996 | Sorenson | |
| 5,518,801 | A | | 5/1996 | Chappell et al. | |
| 5,524,990 | A | | 6/1996 | Buck | |
| 5,547,284 | A | | 8/1996 | Imer | |
| 5,554,093 | A | | 9/1996 | Porchia et al. | |
| 5,575,747 | A | | 11/1996 | Dais et al. | |
| 5,605,594 | A | | 2/1997 | May | |
| 5,618,111 | A | | 4/1997 | Porchia et al. | |
| 5,650,214 | A | | 7/1997 | Anderson et al. | |
| 5,699,932 | A | | 12/1997 | Claydon et al. | |
| 5,730,312 | A | | 3/1998 | Hung | |
| 5,743,458 | A | | 4/1998 | French | |
| 5,743,460 | A | | 4/1998 | Capy et al. | |
| 5,921,390 | A | | 7/1999 | Simhaee | |
| 5,950,818 | A | | 9/1999 | Paulsen | |
| 6,059,458 | A | * | 5/2000 | Belias et al. | 383/75 |
| 6,150,647 | A | | 11/2000 | Anderson et al. | |
| 6,394,651 | B2 | | 5/2002 | Jackson | |
| 6,394,652 | B2 | | 5/2002 | Meyer et al. | |
| 6,402,377 | B1 | * | 6/2002 | Vo et al. | 383/75 |
| 6,939,042 | B2 | * | 9/2005 | Rusnak et al. | 383/71 |
| 6,994,469 | B2 | * | 2/2006 | Sleight et al. | 383/43 |
| 2006/0093766 | A1 | | 5/2006 | Savicki et al. | |
| 2009/0232422 | A1 | * | 9/2009 | Broering et al. | 383/75 |
| 2010/0040309 | A1 | * | 2/2010 | Wood | 383/75 |
| 2010/0046860 | A1 | * | 2/2010 | Kent et al. | 383/75 |

FOREIGN PATENT DOCUMENTS

| | | | | |
|---|---|---|---|---|
| DE | 2437968 | | | 2/1976 |
| DE | 2444742 | | | 4/1976 |
| EP | 0338747 | | | 10/1989 |
| FR | 991671 | | | 10/1951 |
| FR | 2056951 | | | 5/1971 |
| FR | 2576834 | | | 8/1986 |
| GB | 1302940 | | | 1/1971 |
| GB | 2175564 | | | 12/1986 |
| JP | 58089326 | A | * | 5/1983 |
| JP | 04065233 | | | 3/1992 |
| NL | 6918650 | | | 6/1971 |
| WO | WO-92/20593 | | | 11/1992 |
| WO | WO95/00405 | | | 1/1995 |
| WO | WO 96/06733 | | | 3/1996 |
| WO | WO-97/29966 | | | 8/1997 |

* cited by examiner

FLEXIBLE BAG HAVING A DRAWTAPE CLOSURE

FIELD OF THE INVENTION

Flexible bags of the type commonly utilized for the containment and disposal of various household materials.

BACKGROUND OF THE INVENTION

Flexible bags, particularly those made of comparatively inexpensive polymeric materials, have been widely employed for the containment and disposal of various household materials such as trash, lawn clippings, leaves, and the like.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible bags of the type commonly available are typically formed from materials having consistent physical properties throughout the bag structure, such as stretch, tensile, and/or elongation properties.

A common method of utilizing such bags is as a liner for a container such as a trash can or bin. It is often difficult to pull the top of a bag over the rim of the trash can or bin so that the bag stays in place in the trash can or bin. Materials are placed in the bag until the bag is filled to the capacity of the bag and/or container, or until the bag is filled to the desired level. When the bag is filled to capacity, or even beyond capacity due to placing additional materials above the uppermost edge of the bag, it is often difficult for the consumer to achieve closure of the bag opening since little if any free material remains to achieve closure of the bag opening above the level of the contents. If the filled bag is then set upon the floor by itself, another issue frequently encountered is a shifting of the bag contents which causes an imbalance within the bag and a corresponding opening of the closure of the bag with potential spillage of the contents.

Accordingly, it would be desirable to provide a flexible bag which is easier to place securely over the rim of the trash can or bin, which is easier to close when filled and which resists reopening when closed.

SUMMARY OF THE INVENTION

A flexible bag comprising at least one sheet of flexible sheet material assembled to form a semi-enclosed container having an opening defined by a periphery, said opening defining an opening plane, said bag having a drawtape closure for sealing said opening to convert said semi-enclosed container to a closed container, an upper region adjacent to said drawtape closure and a lower region below said upper region, wherein the sheet material of said drawtape closure exhibits an elastic-like behavior along at least one axis, the sheet material of said drawtape closure comprising: at least a first region and a second region, said first region and said second region being comprised of the same material composition and each having an untensioned projected pathlength, said first region undergoing a substantially molecular-level deformation and said second region initially undergoing a substantially geometric deformation when said web material is subjected to an applied elongation in a direction substantially parallel to said axis in response to an externally-applied force upon the sheet material of said drawtape closure, said first region and said second region substantially returning to their untensioned projected pathlength when said applied elongation is released.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
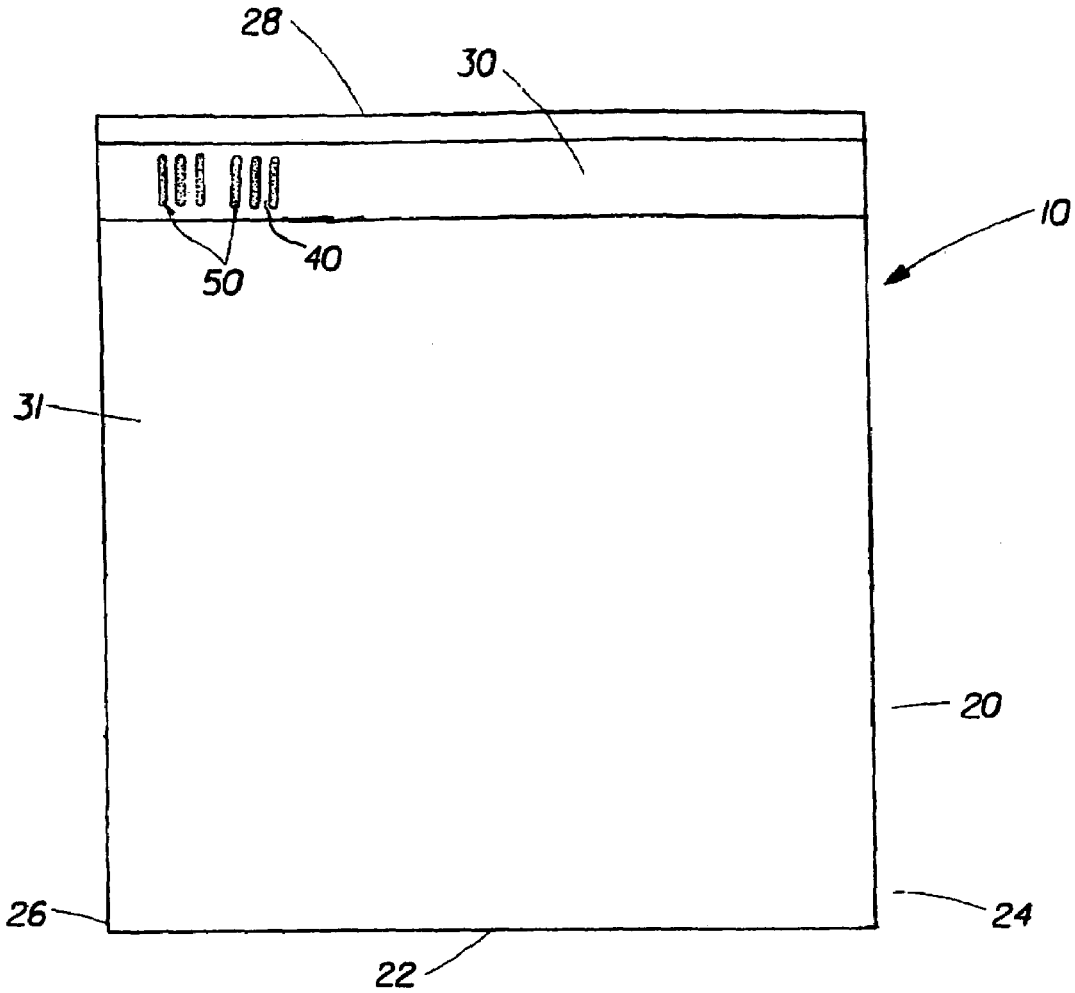
FIG. 1 is a plan view of a flexible bag in accordance with one embodiment of the present invention in a closed, empty condition.

Flexible Bag Construction:

FIG. 1 depicts one embodiment of a flexible bag 10 according to the present invention. In the embodiment depicted in FIG. 1, the flexible bag 10 includes a bag body 20 formed from a piece of flexible sheet material folded upon itself along fold line 22 and bonded to itself along side seams 24 and 26 to form a semi-enclosed container having an opening along edge 28. Flexible bag 10 also includes drawtape closure 30 located adjacent to edge 28 for sealing edge 28 to form a fully-enclosed container or vessel as shown in FIG. 1. Bags such as the flexible bag 10 of FIG. 1 can be also constructed from a continuous tube of sheet material, thereby eliminating side seams 24 and 26 and substituting a bottom seam for fold line 22. Flexible bag 10 is suitable for containing and protecting a wide variety of materials and/or objects contained within the bag body.

In the configuration depicted in FIG. 1, the drawtape closure 30 completely encircles the periphery of the opening formed by edge 28. However, under some circumstances a closure means formed by a lesser degree of encirclement (such as, for example, a closure means disposed along only one side of edge 28) may provide adequate closure integrity.

Flexible bag 10, in accordance with one embodiment of the present invention, includes region 31 adjacent to the closure 30 which is adjacent to the edge 28. The drawtape closure exhibits a lower resistance to elongation than the region 31.

FIG. 1 shows a plurality of regions extending across the drawtape closure surface. Regions 40 comprise rows of deeply-embossed deformations in the flexible sheet material of the bag body 20, while regions 50 comprise intervening undeformed regions. As shown in FIG. 1, the undeformed regions have axes which extend across the material of the bag body in a direction substantially parallel to the plane (axis when in a closed condition) of the open edge 28, which in the configuration shown is also substantially parallel to the plane or axis defined by the bottom edge 22.

In one embodiment the sheet materials are oriented such that their elongation axis in the upper portion of the bag is generally substantially perpendicular to the plane defined by the opening or open edge of the bag. This orientation provides the defined stretch orientations of one embodiment of the present invention. In one embodiment the sheet materials are oriented such that the elongation axis of the drawtape closure is parallel to the plane defined by the opening or open edge of the bag.

It is possible to construct substantially the entire bag body from a sheet material having the structure and characteristics of the embodiments of the present invention. It may be desirable under certain circumstances to provide such materials in only one or more portions or zones of the bag body rather than its entirety. For example, a band of such material having the desired stretch orientation could be provided in one region of the bag forming a complete circular band around the bag body to provide a more localized stretch property. In one embodiment, the band of material comprising the drawtape closure portion of the bag may have the structure and characteristics described herein.

In one embodiment, the first and second regions are formed only in the drawtape closure portion of the bag. This localized formation of the first and second regions may selectively enable the drawtape portion of the bag to be expanded in circumference relative to the remainder of the bag 10. This relative expansion may enable a user of the bag 10 to more easily enclose the periphery of a container adapted to support the bag 10 to facilitate the filling of the bag 10.

The selective formation of the first and second regions in the area of the drawtape closure may additionally yield a benefit of a closure which is more resistant to opening when a filled bag has been closed and subsequently removed from a supporting container than a similar bag lacking the modified drawtape closure would be. Without being bound by theory, it is believed that there is a ratchet effect present in the mechanical interaction between the formed regions of the draw tape and the formed regions of the sheet material as well as an additional ratchet effect between the regions of the respective portions of the sheet material surrounding the draw tape.

The ratchet effect may be achieved by forming the first and second regions in the draw tape and the surrounding hem material, or in either the draw tape or the surrounding hem material alone. Each of the draw tape and the surrounding hem material may be either continuously or selectively formed into first and second regions. By selectively formed it is meant that discrete portions of the material may have first and second regions formed and other portions may have no such regions formed. Such selective formation of first and second regions may achieve a selective ratchet effect wherein the greater resistance to opening is more prevalent in particular preselected portions of the draw tape.

In one embodiment each of the draw tape and the surrounding hem material may comprise a different pattern of first and second regions in order to facilitate the interaction of the regions of the draw tape with those of the surrounding hem material.

Figure 6:
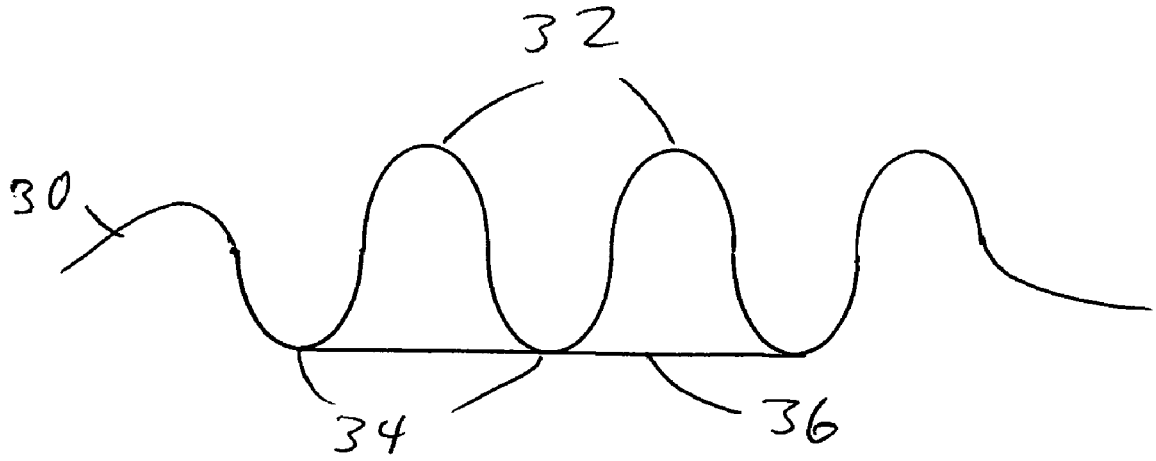
FIG. 6 is a side view illustration of a portion of a drawtape according to one embodiment of the invention.

In one embodiment illustrated in FIG. 6, the draw tape 30 may further comprise one or more looped sections wherein the tape is formed into a series of crests 32 and troughs 34 where each trough 36 of a looped section is sealed to an elastomeric strip 36 corresponding to each looped section. This allows the drawtape 30 to be extended such that exposed portions of the drawtape 30 may be used to secure the tape and the top of the bag over the lip of a bag holding container.

In one embodiment the drawtape may further comprise an elastomeric material such as a thermoplastic rubber compound blended with a polyolefin.

In any of the embodiments, the draw tape, the surrounding hem material, or both may be embossed such that a pattern is present in the material but the first and second regions having differing responses to the application of a force along an axis of the pattern are not formed. Bags formed with such embossed draw tapes and/or hem material may still undergo the ratchet interaction between the embossed pattern of the material and the other components of the draw tape closure.

The draw tape may comprise a polymer substantially similar to that of the sheet material or may comprise a dissimilar polymer material. The sheet material may be modified to include the first and second regions either prior to or subsequent to the addition of the draw tape to the bag 10. Modification of the sheet material subsequent to the addition of the draw tape may include modification of the draw tape to include first regions and second regions as well. In one embodiment, the sheet material including the hem seal formed to constrain the motion of the draw tape, and the draw tape may be modified concurrently using the method described below.

Materials suitable for use in the embodiments of the present invention, as described hereafter, are believed to provide additional benefits in terms of reduced contact area with a trash can or other container, aiding in the removal of the bag after placing contents therein. The three-dimensional nature of the sheet material coupled with its elongation properties also provides enhanced tear and puncture resistance and enhanced visual, aural, and tactile impression. The elongation properties also permit bags to have a greater capacity per unit of material used, improving the "mileage" of such bags. Hence, smaller bags than those of conventional construction may be utilized for a given application. Bags may also be of any shape and configuration desired, including bags having handles or specific cut-out geometries.

Figure 2:
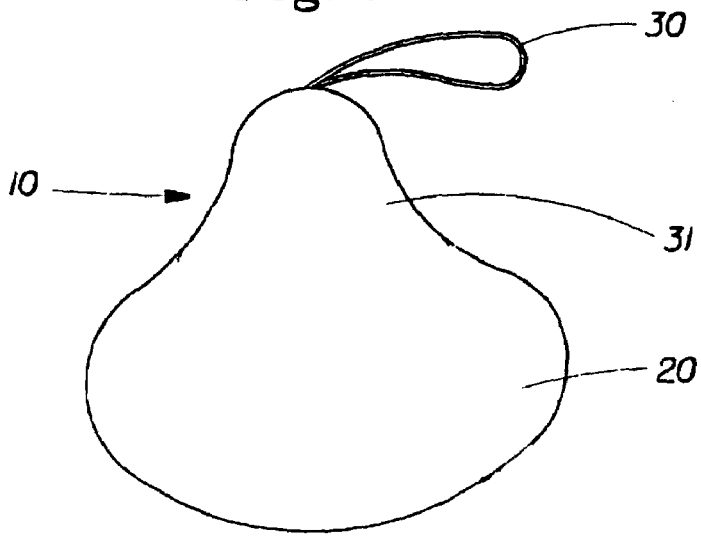
FIG. 2 is a perspective view of the flexible bag of FIG. 1 in a closed condition with material contained therein.
Figure 3A:
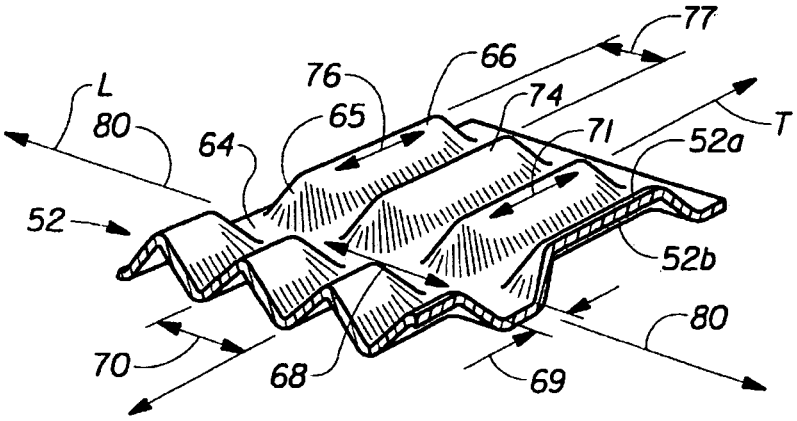
FIG. 3A is a segmented, perspective illustration of the polymeric film material of flexible bags of one embodiment of the present invention in a substantially untensioned condition.

To better illustrate the structural features and performance advantages of flexible bags according to the embodiments of the present invention, FIG. 3A provides a greatly-enlarged partial perspective view of a segment of sheet material 52 suitable for forming the bag body 20 as depicted in FIGS. 1-2. Materials such as those illustrated and described herein as suitable for use in accordance with the embodiments of the present invention, as well as methods for making and characterizing same, are described in greater detail in commonly-assigned U.S. Pat. Ser. No. 5,518,801, issued to Chappell, et al. on May 21, 1996.

Referring now to FIG. 3A, sheet material 52 includes a "strainable network" of distinct regions. As used herein, the term "strainable network" refers to an interconnected and interrelated group of regions which are able to be extended to some useful degree in a predetermined direction providing the sheet material with an elastic-like behavior in response to an applied and subsequently released elongation. The strainable network includes at least a first region 64 and a second region 66. Sheet material 52 includes a transitional region 65 which is at the interface between the first region 64 and the second region 66. The transitional region 65 will exhibit complex combinations of the behavior of both the first region and the second region. It is recognized that every embodiment of such sheet materials suitable for use in accordance with the present invention will have a transitional region; however, such materials are defined by the behavior of the sheet material in the first region 64 and the second region 66. Therefore, the ensuing description will be concerned with the behavior of the sheet material in the first regions and the second regions only since it is not dependent upon the complex behavior of the sheet material in the transitional regions 65.

Sheet material 52 has a first surface 52 *a* and an opposing second surface 52 *b*. In the embodiment shown in FIG. 3A, the strainable network includes a plurality of first regions 64 and a plurality of second regions 66. The first regions 64 have a first axis 68 and a second axis 69, wherein the first axis 68 is preferably longer than the second axis 69. The first axis 68 of the first region 64 is substantially parallel to the longitudinal axis "L" of the sheet material 52 while the second axis 69 is substantially parallel to the transverse axis "T" of the sheet material 52. Preferably, the second axis of the first region, the width of the first region, is from about 0.01 inches to about 0.5 inches and more preferably from about 0.03 inches to about 0.25 inches. The second regions 66 have a first axis 70 and a second axis 71. The first axis 70 is substantially parallel to the longitudinal axis of the sheet material 52, while the second axis 71 is substantially parallel to the transverse axis of the sheet material 52. Preferably, the second axis of the second region, the width of the second region, is from about 0.01 inches to about 2.0 inches and more preferably from about 0.125 inches to about 1.0 inches. In the embodiment of FIG. 3A, the first regions 64 and the second regions 66 are substantially linear, extending continuously in a direction substantially parallel to the longitudinal axis of the sheet material 52.

The first region 64 has an elastic modulus E 1 and a cross-sectional area A 1. The second region 66 has a modulus E 2 and a cross-sectional area A 2.

In the illustrated embodiment, the sheet material 52 has been "formed" such that the sheet material 52 exhibits a resistive force along an axis, which in the case of the illustrated embodiment is substantially parallel to the longitudinal axis of the web, when subjected to an applied axial elongation in a direction substantially parallel to the longitudinal axis. As used herein, the term "formed" refers to the creation of a desired structure or geometry upon a sheet material that will substantially retain the desired structure or geometry when it is not subjected to any externally applied elongations or forces. A sheet material of the embodiments of the present invention is comprised of at least a first region and a second region, wherein the first region is visually distinct from the second region. As used herein, the term "visually distinct" refers to features of the sheet material which are readily discernible to the normal naked eye when the sheet material or objects embodying the sheet material are subjected to normal use. As used herein the term "surface-pathlength" refers to a measurement along the topographic surface of the region in question in a direction substantially parallel to an axis. The method for determining the surface-pathlength of the respective regions can be found in the Test Methods section of the above-referenced Chappell et al. patent.

Methods for forming such sheet materials useful in the embodiments of the present invention include, but are not limited to, embossing by mating plates or rolls, thermoforming, high pressure hydraulic forming, or casting. While the entire portion of the web 52 has been subjected to a forming operation, the present invention may also be practiced by subjecting to formation only a portion thereof, e.g., a portion of the material comprising the bag body 20, as will be described in detail below.

In the embodiment shown in FIG. 3A, the first regions 64 are substantially planar. That is, the material within the first region 64 is in substantially the same condition before and after the formation step undergone by web 52. The second regions 66 include a plurality of raised rib-like elements 74. The rib-like elements may be embossed, debossed or a combination thereof. The rib-like elements 74 have a first or major axis 76 which is substantially parallel to the transverse axis of the web 52 and a second or minor axis 77 which is substantially parallel to the longitudinal axis of the web 52. The length parallel to the first axis 76 of the rib-like elements 74 is at least equal to, and preferably longer than the length parallel to the second axis 77. Preferably, the ratio of the first axis 76 to the second axis 77 is at least about 1:1 or greater, and more preferably at least about 2:1 or greater.

The rib-like elements 74 in the second region 66 may be separated from one another by unformed areas. Preferably, the rib-like elements 74 are adjacent one another and are separated by an unformed area of less than 0.10 inches as measured perpendicular to the major axis 76 of the rib-like elements 74, and more preferably, the rib-like elements 74 are contiguous having essentially no unformed areas between them.

The first region 64 and the second region 66 each have a "projected pathlength". As used herein the term "projected pathlength" refers to the length of a shadow of a region that would be thrown by parallel light. The projected pathlength of the first region 64 and the projected pathlength of the second region 66 are equal to one another.

The first region 64 has a surface-pathlength, L 1, less than the surface-pathlength, L 2, of the second region 66 as measured topographically in a direction parallel to the longitudinal axis of the web 52 while the web is in an untensioned condition. Preferably, the surface-pathlength of the second region 66 is at least about 15% greater than that of the first region 64, more preferably at least about 30% greater than that of the first region, and most preferably at least about 70% greater than that of the first region. In general, the greater the surface-pathlength of the second region, the greater will be the elongation of the web before encountering the force wall. Suitable techniques for measuring the surface-pathlength of such materials are described in the above-referenced Chappell et al. patent.

Sheet material 52 exhibits a modified "Poisson lateral contraction effect" substantially less than that of an otherwise identical base web of similar material composition. The method for determining the Poisson lateral contraction effect of a material can be found in the Test Methods section of the above-referenced Chappell et al. patent. Preferably, the Poisson lateral contraction effect of webs suitable for use in the present invention is less than about 0.4 when the web is subjected to about 20% elongation. Preferably, the webs exhibit a Poisson lateral contraction effect less than about 0.4 when the web is subjected to about 40, 50 or even 60% elongation. More preferably, the Poisson lateral contraction effect is less than about 0.3 when the web is subjected to 20, 40, 50 or 60% elongation. The Poisson lateral contraction effect of such webs is determined by the amount of the web material which is occupied by the first and second regions, respectively. As the area of the sheet material occupied by the first region increases the Poisson lateral contraction effect also increases. Conversely, as the area of the sheet material occupied by the second region increases the Poisson lateral contraction effect decreases. Preferably, the percent area of the sheet material occupied by the first area is from about 2% to about 90%, and more preferably from about 5% to about 50%.

Sheet materials of the prior art which have at least one layer of an elastomeric material will generally have a large Poisson lateral contraction effect, i.e., they will "neck down" as they elongate in response to an applied force. Web materials useful in accordance with the present invention can be designed to moderate if not substantially eliminate the Poisson lateral contraction effect.

For sheet material 52, the direction of applied axial elongation, D, indicated by arrows 80 in FIG. 3A, is substantially perpendicular to the first axis 76 of the rib-like elements 74. The rib-like elements 74 are able to unbend or geometrically deform in a direction substantially perpendicular to their first axis 76 to allow extension in web 52.

Figure 3B:
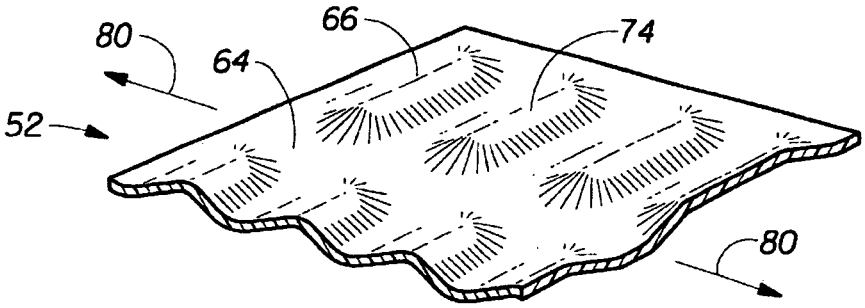
FIG. 3B is a segmented, perspective illustration of the polymeric film material of flexible bags according to one embodiment of the present invention in a partially-tensioned condition.

Referring now to FIG. 3B, as web of sheet material 52 is subjected to an applied axial elongation, D, indicated by arrows 80 in FIG. 3B, the first region 64 having the shorter surface-pathlength, L1, provides most of the initial resistive force, P1, as a result of molecular-level deformation, to the applied elongation. In this stage, the rib-like elements 74 in the second region 66 are experiencing geometric deformation, or unbending and offer minimal resistance to the applied elongation. In transition to the next stage, the rib-like elements 74 are becoming aligned with (i.e., coplanar with) the applied elongation. That is, the second region is exhibiting a change from geometric deformation to molecular-level deformation. This is the onset of the force wall. In the stage seen in FIG. 3C, the rib-like elements 74 in the second region 66 have become substantially aligned with (i.e., coplanar with) the plane of applied elongation (i.e. the second region has reached its limit of geometric deformation) and begin to resist further elongation via molecular-level deformation. The second region 66 now contributes, as a result of molecular-level deformation, a second resistive force, P2, to further applied elongation. The resistive forces to elongation provided by both the molecular-level deformation of the first region 64 and the molecular-level deformation of the second region 66 provide a total resistive force, PT, which is greater than the resistive force which is provided by the molecular-level deformation of the first region 64 and the geometric deformation of the second region 66.

The resistive force P1 is substantially greater than the resistive force P2 when (L1+D) is less than L2. When (L1+D) is less than L2 the first region provides the initial resistive force P1, generally satisfying the equation: P1=(A1×E1×D)L1

When (L1+D) is greater than L2 the first and second regions provide a combined total resistive force PT to the applied elongation, D, generally satisfying the equation: PT=(A1×E1×D)L1+(A2×E2×□L1+D−L2□)L2

Figure 3C:
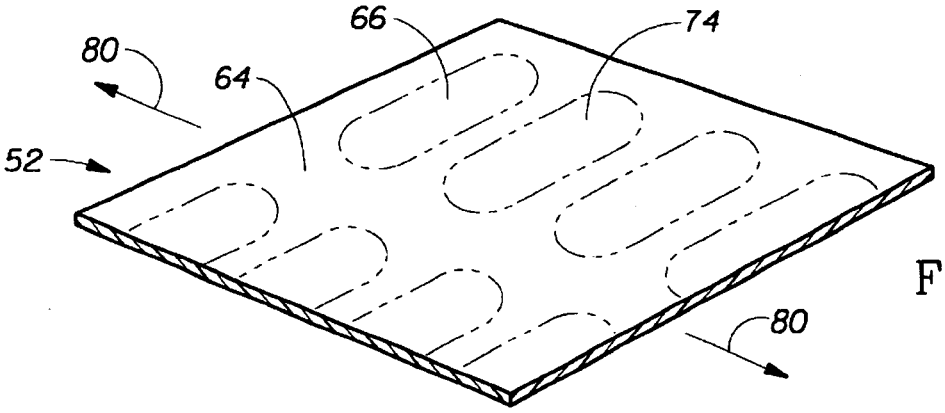
FIG. 3C is a segmented, perspective illustration of the polymeric film material of flexible bags according to one embodiment of the present invention in a greater-tensioned condition.

The maximum elongation occurring while in the stage corresponding to FIGS. 3A and 3B, before reaching the stage depicted in FIG. 3C, is the "available stretch" of the formed web material. The available stretch corresponds to the distance over which the second region experiences geometric deformation. The range of available stretch can be varied from about 10% to 100% or more, and can be largely controlled by the extent to which the surface-pathlength L2 in the second region exceeds the surface-pathlength L1 in the first region and the composition of the base film. The term available stretch is not intended to imply a limit to the elongation which the web of the present invention may be subjected to as there are applications where elongation beyond the available stretch is desirable.

When the sheet material is subjected to an applied elongation, the sheet material exhibits an elastic-like behavior as it extends in the direction of applied elongation and returns to its substantially untensioned condition once the applied elongation is removed, unless the sheet material is extended beyond the point of yielding. The sheet material is able to undergo multiple cycles of applied elongation without losing its ability to substantially recover. Accordingly, the web is able to return to its substantially untensioned condition once the applied elongation is removed.

While the sheet material may be easily and reversibly extended in the direction of applied axial elongation, in a direction substantially perpendicular to the first axis of the rib-like elements, the web material is not as easily extended in a direction substantially parallel to the first axis of the rib-like elements. The formation of the rib-like elements allows the rib-like elements to geometrically deform in a direction substantially perpendicular to the first or major axis of the rib-like elements, while requiring substantially molecular-level deformation to extend in a direction substantially parallel to the first axis of the rib-like elements.

The amount of applied force required to extend the web is dependent upon the composition and cross-sectional area of the sheet material and the width and spacing of the first regions, with narrower and more widely spaced first regions requiring lower applied extensional forces to achieve the desired elongation for a given composition and cross-sectional area. The first axis, (i.e., the length) of the first regions is preferably greater than the second axis, (i.e., the width) of the first regions with a length to width ratio of from about 5:1 or greater.

The depth and frequency of rib-like elements can also be varied to control the available stretch of a web of sheet material suitable for use in accordance with the present invention. The available stretch is increased if for a given frequency of rib-like elements, the height or degree of formation imparted on the rib-like elements is increased. Similarly, the available stretch is increased if for a given height or degree of formation, the frequency of the rib-like elements is increased.

There are several functional properties that can be controlled through the application of such materials to flexible bags of the present invention. The functional properties are the resistive force exerted by the sheet material against an applied elongation and the available stretch of the sheet material before the force wall is encountered. The resistive force that is exerted by the sheet material against an applied elongation is a function of the material (e.g., composition, molecular structure and orientation, etc.) and cross-sectional area and the percent of the projected surface area of the sheet material that is occupied by the first region. The higher the percent area coverage of the sheet material by the first region, the higher the resistive force that the web will exert against an applied elongation for a given material composition and cross-sectional area. The percent coverage of the sheet material by the first region is determined in part, if not wholly, by the widths of the first regions and the spacing between adjacent first regions.

The available stretch of the web material is determined by the surface-pathlength of the second region. The surface-pathlength of the second region is determined at least in part by the rib-like element spacing, rib-like element frequency and depth of formation of the rib-like elements as measured perpendicular to the plane of the web material. In general, the greater the surface-pathlength of the second region the greater the available stretch of the web material.

As discussed above with regard to FIGS. 3A-3C, the sheet material 52 initially exhibits a certain resistance to elongation provided by the first region 64 while the rib-like elements 74 of the second region 66 undergo geometric motion. As the rib-like elements transition into the plane of the first regions of the material, an increased resistance to elongation is exhibited as the entire sheet material then undergoes molecular-level deformation. Accordingly, sheet materials of the type depicted in FIGS. 3A-3C and described in the above-referenced Chappell et al. patent provide the performance advantages of the present invention when formed into closed containers such as the flexible bags of the present invention.

An additional benefit realized by the utilization of the aforementioned sheet materials in constructing flexible bags according to the present invention is the increase in visual and tactile appeal of such materials. Polymeric films commonly utilized to form such flexible polymeric bags are typically comparatively thin in nature and frequently have a smooth, shiny surface finish. While some manufacturers utilize a small degree of embossing or other texturing of the film surface, at least on the side facing outwardly of the finished bag, bags made of such materials still tend to exhibit a slippery and flimsy tactile impression. Thin materials coupled with substantially two-dimensional surface geometry also tend to leave the consumer with an exaggerated impression of the thinness, and perceived lack of durability, of such flexible polymeric bags.

In contrast, sheet materials useful in accordance with the present invention such as those depicted in FIGS. 3A-3C exhibit a three-dimensional cross-sectional profile wherein the sheet material is (in an un-tensioned condition) deformed out of the predominant plane of the sheet material. This provides additional surface area for gripping and dissipates the glare normally associated with substantially planar, smooth surfaces. The three-dimensional rib-like elements also provide a "cushiony" tactile impression when the bag is gripped in one's hand, also contributing to a desirable tactile impression versus conventional bag materials and providing an enhanced perception of thickness and durability. The additional texture also reduces noise associated with certain types of film materials, leading to an enhanced aural impression.

Suitable mechanical methods of forming the base material into a web of sheet material suitable for use in the present invention are well known in the art and are disclosed in the aforementioned Chappell et al. patent and commonly-assigned U.S. Pat. Ser. No. 5,650,214, issued Jul. 22, 1997 in the names of Anderson et al.

Another method of forming the base material into a web of sheet material suitable for use in the present invention is vacuum forming. An example of a vacuum forming method is disclosed in commonly assigned U.S. Pat. Ser. No. 4,342,314, issued to Radel et al. on Aug. 3, 1982. Alternatively, the formed web of sheet material may be hydraulically formed in accordance with the teachings of commonly assigned U.S. Pat. Ser. No. 4,609,518 issued to Curro et al. on Sep. 2, 1986.

The method of formation can be accomplished in a static mode, where one discrete portion of a base film is deformed at a time. Alternatively, the method of formation can be accomplished using a continuous, dynamic press for intermittently contacting the moving web and forming the base material into a formed web material of the present invention. These and other suitable methods for forming the web material of the present invention are more fully described in the above-referenced Chappell et al. patent. The flexible bags may be fabricated from formed sheet material or, alternatively, the flexible bags may be fabricated and then subjected to the methods for forming the sheet material.

Figure 4:
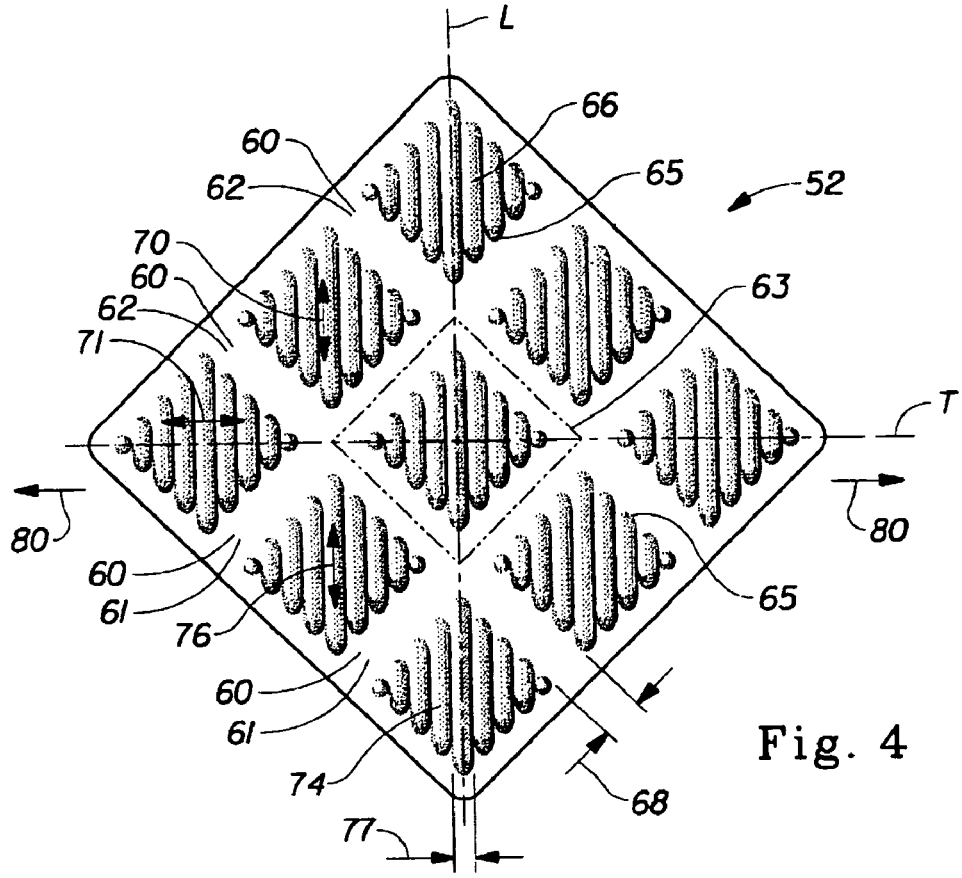
FIG. 4 is a plan view illustration of another embodiment of a sheet material useful in the present invention.

Referring now to FIG. 4, other patterns for first and second regions may also be employed as sheet materials 52 suitable for use in accordance with the present invention. The sheet material 52 is shown in FIG. 4 in its substantially untensioned condition. The sheet material 52 has two centerlines, a longitudinal centerline, which is also referred to hereinafter as an axis, line, or direction "L" and a transverse or lateral centerline, which is also referred to hereinafter as an axis, line, or direction "T". The transverse centerline "T" is generally perpendicular to the longitudinal centerline "L". Materials of the type depicted in FIG. 4 are described in greater detail in the aforementioned Anderson et al. patent.

As discussed above with regard to FIGS. 3A-3C, sheet material 52 includes a "strainable network" of distinct regions. The strainable network includes a plurality of first regions 60 and a plurality of second regions 66 which are visually distinct from one another. Sheet material 52 also includes transitional regions 65 which are located at the interface between the first regions 60 and the second regions 66. The transitional regions 65 will exhibit complex combinations of the behavior of both the first region and the second region, as discussed above.

Sheet material 52 has a first surface, (facing the viewer in FIG. 4), and an opposing second surface (not shown). In the embodiment shown in FIG. 4, the strainable network includes a plurality of first regions 60 and a plurality of second regions 66. A portion of the first regions 60, indicated generally as 61, are substantially linear and extend in a first direction. The remaining first regions 60, indicated generally as 62, are substantially linear and extend in a second direction which is substantially perpendicular to the first direction. The first direction may be perpendicular to the second direction. Other angular relationships between the first direction and the second direction may be suitable so long as the first regions 61 and 62 intersect one another. The angle between the first and second directions ranges from about 45° to about 135°. In one embodiment the angle is about 90°. The intersection of the first regions 61 and 62 forms a boundary, indicated by phantom line 63 in FIG. 4, which completely surrounds the second regions 66.

In one embodiment the width 68 of the first regions 60 may be from about 0.01 inches to about 0.5 inches. In another embodiment the width 68 of the first regions 60 may be from about 0.03 inches to about 0.25 inches. However, other width dimensions for the first regions 60 may be suitable. Because the first regions 61 and 62 are perpendicular to one another and equally spaced apart, the second regions have a square shape. However, other shapes for the second region 66 are suitable and may be achieved by changing the spacing between the first regions and/or the alignment of the first regions 61 and 62 with respect to one another. The second regions 66 have a first axis 70 and a second axis 71. The first axis 70 is substantially parallel to the longitudinal axis of the web material 52, while the second axis 71 is substantially parallel to the transverse axis of the web material 52. The first regions 60 have an elastic modulus E 1 and a cross-sectional area A 1. The second regions 66 have an elastic modulus E 2 and a cross-sectional area A 2.

In the embodiment shown in FIG. 4, the first regions 60 are substantially planar. That is, the material within the first regions 60 is in substantially the same condition before and after the formation step undergone by web 52. The second regions 66 include a plurality of raised rib-like elements 74. The rib-like elements 74 may be embossed, debossed or a combination thereof. The rib-like elements 74 have a first or major axis 76 which is substantially parallel to the longitudinal axis of the web 52 and a second or minor axis 77 which is substantially parallel to the transverse axis of the web 52.

The rib-like elements 74 in the second region 66 may be separated from one another by unformed areas, essentially unembossed or debossed, or simply formed as spacing areas.

Preferably, the rib-like elements 74 are adjacent one another and are separated by an unformed area of less than 0.10 inches as measured perpendicular to the major axis 76 of the rib-like elements 74, and more preferably, the rib-like elements 74 are contiguous having essentially no unformed areas between them.

The first regions 60 and the second regions 66 each have a "projected pathlength". As used herein the term "projected pathlength" refers to the length of a shadow of a region that would be thrown by parallel light. The projected pathlength of the first region 60 and the projected pathlength of the second region 66 are equal to one another.

The first region 60 has a surface-pathlength, L1, less than the surface-pathlength, L2, of the second region 66 as measured topographically in a parallel direction while the web is in an untensioned condition. Preferably, the surface-pathlength of the second region 66 is at least about 15% greater than that of the first region 60, more preferably at least about 30% greater than that of the first region, and most preferably at least about 70% greater than that of the first region. In general, the greater the surface-pathlength of the second region, the greater will be the elongation of the web before encountering the force wall.

For sheet material 52, the direction of applied axial elongation, D, indicated by arrows 80 in FIG. 4, is substantially perpendicular to the first axis 76 of the rib-like elements 74. This is due to the fact that the rib-like elements 74 are able to unbend or geometrically deform in a direction substantially perpendicular to their first axis 76 to allow extension in web 52.

Figure 5:
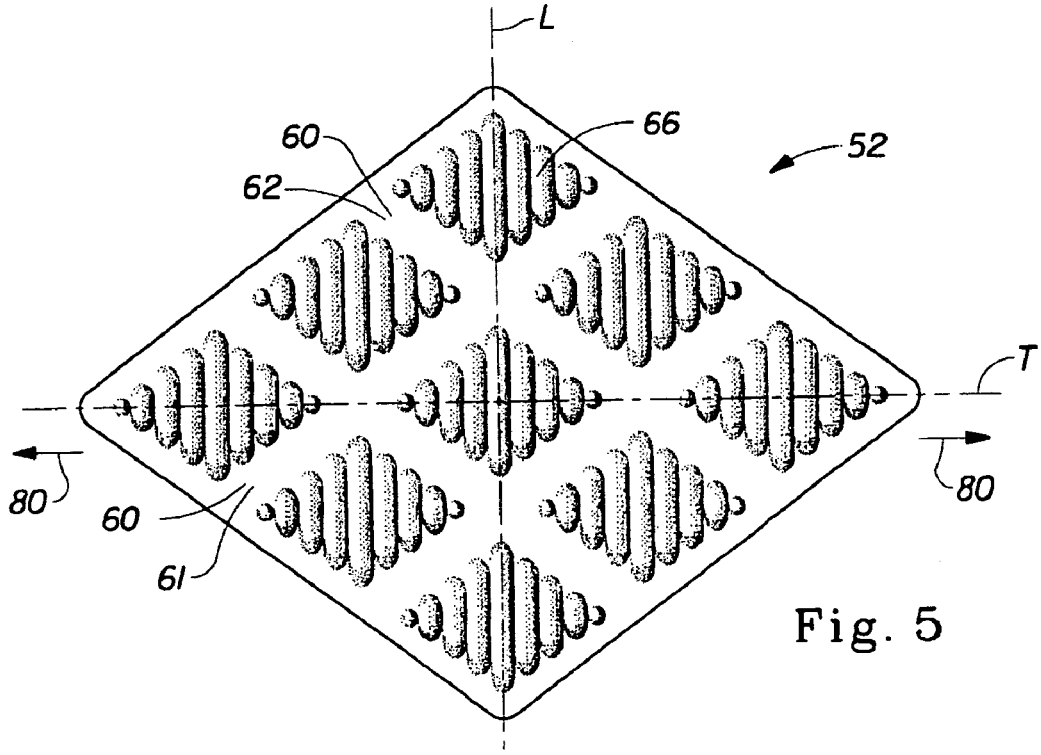
FIG. 5 is a plan view illustration of a polymeric web material of FIG. 4 in a partially-tensioned condition similar to the depiction of FIG. 3 B.

Referring now to FIG. 5, as web 52 is subjected to an applied axial elongation, D, indicated by arrows 80 in FIG. 5, the first regions 60 having the shorter surface-pathlength, L1, provide most of the initial resistive force, P1, as a result of molecular-level deformation, to the applied elongation which corresponds to stage I. While in stage I, the rib-like elements 74 in the second regions 66 are experiencing geometric deformation, or unbending and offer minimal resistance to the applied elongation. In addition, the shape of the second regions 66 changes as a result of the movement of the reticulated structure formed by the intersecting first regions 61 and 62. Accordingly, as the web 52 is subjected to the applied elongation, the first regions 61 and 62 experience geometric deformation or bending, thereby changing the shape of the second regions 66. The second regions are extended or lengthened in a direction parallel to the direction of applied elongation, and collapse or shrink in a direction perpendicular to the direction of applied elongation.

In addition to the aforementioned elastic-like properties, a sheet material of the type depicted in FIGS. 4 and 5 is believed to provide a softer, more cloth-like texture and appearance, and is more quiet in use.

Various compositions suitable for constructing the flexible bags of embodiments of the present invention include substantially impermeable materials such as polyvinyl chloride (PVC), polyvinylidene chloride (PVDC), polyethylene (PE), polypropylene (PP), aluminum foil, coated waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat, mechanical, or adhesive sealing technologies may be utilized to join various components or elements of the bag to themselves or to each other. In addition, the bag bodies may be thermoformed, blown, or otherwise molded rather than reliance upon folding and bonding techniques to construct the bag bodies from a web or sheet of material. Two recent U.S. patents which are illustrative of the state of the art with regard to flexible storage bags similar in overall structure to those depicted in FIGS. 1 and 2 but of the types currently available are U.S. Pat. Ser. No. 5,554,093, issued Sep. 10, 1996 to Porchia et al., and U.S. Pat. Ser. No. 5,575,747, issued Nov. 19, 1996 to Dais et al.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible bag comprising at least one sheet of flexible sheet material assembled to form a semi-enclosed container having an opening defined by a periphery, said opening defining an opening plane, said bag having a drawtape closure for sealing said opening to convert said semi-enclosed container to a closed container, an upper region adjacent to said drawtape closure and a lower region below said upper region, wherein the sheet material of said drawtape closure exhibits an elastic-like behavior along at least one axis, the sheet material of said drawtape closure comprising: at least a first region and a second region, said first region and said second region being comprised of the same material composition and each having an untensioned projected pathlength, said first region undergoing a substantially molecular-level deformation and said second region initially undergoing a substantially geometric deformation when said sheet material is subjected to an applied elongation in a direction substantially parallel to said axis in response to an externally-applied force upon the sheet material of said drawtape closure, wherein said first region and said second region are visually distinct from one another, and wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding said second regions.

2. A flexible bag comprising at least one sheet of flexible sheet material assembled to form a semi-enclosed container having an opening defined by a periphery, said opening defining an opening plane, said bag having a drawtape closure for sealing said opening to convert said semi-enclosed container to a closed container, an upper region adjacent to said drawtape closure and a lower region below said upper region, wherein the sheet material of said drawtape closure exhibits an elastic-like behavior along at least one axis, the sheet material of said drawtape closure comprising: at least a first region and a second region, said first region and said second region being comprised of the same material composition and each having an untensioned projected pathlength, said first region undergoing a substantially molecular-level deformation and said second region initially undergoing a substantially geometric deformation when said sheet material is subjected to an applied elongation in a direction substantially parallel to said axis in response to an externally-applied force upon the sheet material of said drawtape closure, wherein said sheet material exhibits at least two significantly different stages of resistive forces to an applied axial elongation along at least one axis when subjected to the applied elongation in a direction parallel to said axis in response to an externally-applied force upon said flexible storage bag when formed into a closed container, said sheet material comprising: strainable network including at least two visually distinct regions, one of said regions being configured so that it will exhibit a resistive force in response to said applied axial elongation in a direction parallel to said axis before a substantial portion of the other of said regions develops a significant resistive force to said applied axial elongation, at least one of said regions having a surface- pathlength which is greater than that of the other of said regions as measured parallel to said axis while said sheet material is in an untensioned condition, said region exhibiting said longer surface-pathlength including one or more rib-like elements, said sheet material exhibiting a first resistive force to the applied elongation until the elongation of said sheet material is great enough to cause a substantial portion of said region having a longer surface-pathlength to enter the plane of the applied axial elongation, whereupon said sheet material exhibits a second resistive force to further applied axial elongation, said sheet material exhibiting a total resistive force higher than the resistive force of said first region.

3. The flexible bag of claim 2, wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding said second regions.

4. A flexible bag comprising at least one sheet of flexible sheet material assembled to form a semi-enclosed container having an opening defined by a periphery, said opening defining an opening plane, said bag having a drawtape closure for sealing said opening to convert said semi-enclosed container to a closed container, an upper region adjacent to said drawtape closure and a lower region below said upper region, wherein the sheet material of said drawtape closure exhibits an elastic-like behavior along at least one axis, the sheet material of said drawtape closure comprising: at least a first region and a second region, said first region and said second region being comprised of the same material composition and each having an untensioned projected pathlength, said first region undergoing a substantially molecular-level deformation and said second region initially undergoing a substantially geometric deformation when said sheet material is subjected to an applied elongation in a direction substantially parallel to said axis in response to an externally-applied force upon the sheet material of said drawtape closure, wherein said sheet material exhibits at least two-stages of resistive forces to an applied axial elongation, D, along at least one axis when subjected to the applied axial elongation along said axis in response to an externally-applied force upon said flexible storage bag when formed into a closed container, said sheet material comprising: a strainable network of visually distinct regions, said strainable network including at least a first region and a second region, said first region having a first surface-pathlength, L1, as measured parallel to said axis while said sheet material is in an untensioned condition, said second region having a second surface-pathlength, L2, as measured parallel to said axis while said web material is in an untensioned condition, said first surface-pathlength, Ll, being less than said second surface-pathlength, L2, said first region producing by itself a resistive force, P1, in response to an applied axial elongation, D, said second region producing by itself a resistive force, P2, in response to said applied axial elongation, D, said resistive force P1 being substantially greater than said resistive force P2 when (L1+D) is less than L2.

5. The flexible bag of claim 4, wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding said second regions.

6. The flexible bag of claim 5, wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding said second regions.

* * * * *